US009008276B2

(12) United States Patent
Matsumoto et al.

(10) Patent No.: US 9,008,276 B2
(45) Date of Patent: Apr. 14, 2015

(54) X-RAY TUBE

(71) Applicant: Futaba Corporation, Mobara-shi, Chiba (JP)

(72) Inventors: Akira Matsumoto, Mobara (JP); Yoshihisa Marushima, Mobara (JP); Yuuichi Kogure, Mobara (JP); Kazuhito Nakamura, Mobara (JP)

(73) Assignee: Futaba Corporation, Mobara-Shi, Chiba (JP)

( * ) Notice: Subject to any disclaimer, the term of this patent is extended or adjusted under 35 U.S.C. 154(b) by 271 days.

(21) Appl. No.: 13/781,846

(22) Filed: Mar. 1, 2013

(65) Prior Publication Data

US 2013/0230147 A1 Sep. 5, 2013

(30) Foreign Application Priority Data

Mar. 5, 2012 (JP) ..... 2012-048067

(51) Int. Cl.

| | |
|---|---|
| ***H01J 35/02*** | (2006.01) |
| ***H01J 35/18*** | (2006.01) |
| ***H01J 35/06*** | (2006.01) |
| *H01J 35/04* | (2006.01) |

(52) U.S. Cl.

CPC ..... *H01J 35/18* (2013.01); *H01J 2235/186* (2013.01); *H01J 2235/087* (2013.01); *H01J 35/045* (2013.01); *H01J 35/06* (2013.01)

(58) Field of Classification Search

CPC ..... H01J 35/04; H01J 35/045; H01J 35/06; H01J 35/062; H01J 35/065; H01J 35/14; H01J 35/18; H01J 2235/06; H01J 2235/08; H01J 2235/083; H01J 2235/084; H01J 2235/087; H01J 2235/18; H01J 2235/183; H01J 2235/186

See application file for complete search history.

(56) References Cited

U.S. PATENT DOCUMENTS

| | | | | |
|---|---|---|---|---|
| 3,788,892 | A * | 1/1974 | van Raalte et al. | 427/107 |
| 4,670,894 | A * | 6/1987 | Birnbach et al. | 378/122 |
| 6,044,130 | A * | 3/2000 | Inazura et al. | 378/138 |
| 6,351,520 | B1 * | 2/2002 | Inazaru | 378/138 |

(Continued)

FOREIGN PATENT DOCUMENTS

| | | | |
|---|---|---|---|
| EP | 0400655 | A1 | 12/1990 |
| JP | H03282400 | A | 12/1991 |

(Continued)

OTHER PUBLICATIONS

Korean Intellectual Property Office, Office Action, Application No. 10-2013-0021009, Jul. 23, 2014, 7 pages.

*Primary Examiner* — Thomas R Artman

(74) *Attorney, Agent, or Firm* — Quarles & Brady LLP

(57) ABSTRACT

An X-ray tube is disclosed. The X-ray tube includes a substrate, a box-shaped case attached to the substrate and being in a high-vacuum state, an X-ray target arranged in the opening of the first substrate in the inside of the case, and a cathode arranged in the case and supplying an electron to the X-ray target. The substrate includes first and second substrates made of 426 alloy and respectively having an opening of honeycomb structure, and an X-ray transmissive window sandwiched between the first and second substrates which is made of a titanium foil and close the opening. The X-ray transmissive window is reinforced by a honeycomb structure of the substrate from both surfaces. Thus, the substrate and the X-ray transmissive window are not deformed, and strength of the package is improved.

5 Claims, 4 Drawing Sheets

(56) References Cited

U.S. PATENT DOCUMENTS

| | | | | |
|---|---|---|---|---|
| 6,487,272 | B1 * | 11/2002 | Kutsuzawa | 378/140 |
| 6,553,096 | B1 * | 4/2003 | Zhou et al. | 378/122 |
| 6,661,876 | B2 * | 12/2003 | Turner et al. | 378/138 |
| 7,236,568 | B2 * | 6/2007 | Dinsmore et al. | 378/139 |
| 7,382,862 | B2 * | 6/2008 | Bard et al. | 378/121 |
| 7,447,298 | B2 * | 11/2008 | Busta et al. | 378/122 |
| 7,623,629 | B2 * | 11/2009 | Ito et al. | 378/121 |
| 7,783,011 | B2 * | 8/2010 | Ito et al. | 378/121 |
| 2007/0211862 | A1 * | 9/2007 | Ito et al. | 378/140 |
| 2009/0161831 | A1 * | 6/2009 | Ito et al. | 378/140 |
| 2010/0074410 | A1 * | 3/2010 | Ito et al. | 378/140 |
| 2013/0230147 | A1 * | 9/2013 | Matsumoto et al. | 378/140 |
| 2014/0093047 | A1 * | 4/2014 | Matsumoto et al. | 378/140 |
| 2014/0362976 | A1 * | 12/2014 | Matsumoto et al. | 378/140 |

FOREIGN PATENT DOCUMENTS

| | | | |
|---|---|---|---|
| JP | 2005-116534 | A1 | 4/2005 |
| JP | 2012038475 | A | 2/2012 |
| KR | 1020070026026 | | 3/2007 |
| WO | 2007135812 | A1 | 11/2007 |

* cited by examiner

X-RAY TUBE

CROSS REFERENCE TO RELATED APPLICATION

This application claims priority of Japan Patent Application No. 2012-048067 and the fuel content of that application is incorporated by reference.

TECHNICAL FIELD

The present invention relates to an X-ray tube emitting electrons from an electron source located within a package of a high-vacuum state, and permitting electrons to collide with an X-ray target, thereby the X-ray emitted from the X-ray target is radiated from an X-ray transmissive window to the outside of the package. In particular, the present invention relates to an X-ray tube which increases the strength of the package by improving the X-ray transmissive window.

BACKGROUND OF THE INVENTION

An X-ray generator for generating ion-gas by X-irradiating air is disclosed in Japanese Patent Publication 2005-116534. The X-ray tube used for the X-ray generator is formed of a cylindrical package or a bulb as a main body. In the package, electrons emitted from a filament is focused and subjected to collide with an X-ray target so that the X-ray is generated. Then, the X-ray passes through an X-ray transmissive output window, and exits outside of the package.

FIG. 8 is a cross-sectional view of round shaped X-ray tube similar to the X-ray tube explained herein above. The round shaped X-ray tube includes a main body formed of a cylindrical package 100 made of glass. On one side of the cylindrical package 100, a circular opening is formed which is closed by an X-ray transmissive window 101 consisting of a beryllium film, and the inside of the cylindrical package 100 is maintained in a high-vacuum state. On the inside surface of the X-ray transmissive window 101 in the package 100, an X-ray target 102 is arranged. In the other side of the cylindrical package 100, a cathode 103 as an electron source and a control electrode 104 are arranged. Electrons emitted from the cathode 103 is accelerated and forced by the control electrode 104, and collides with the X-ray target 102, and the X-ray is emitted from the X-ray transmissive window 101 to the outside of the package 100. Furthermore, as shown in FIG. 8, the X-ray emitted from the X-ray transmissive window 101 to the outside of the package 100 is graphically indicated by the mark X, and the center of X-ray emission in the X-ray transmissive window 101 is shown by the mark P.

In the conventional X-ray tube shown in FIG. 8, electrons emitted from the cathode 103 bring into focus in the shape of a beam, namely, a dot-shaped X-ray irradiation extending radially from the focus point P on which the electrons collide with the target 102. After the X-ray exits from the X-ray transmissive window 101, the X-ray is expanded like a cone shape as shown by the mark X in FIG. 8. Accordingly, an effective irradiation area is smaller than the size of an irradiation object. Thus, in order to x-irradiate over a wide range by using the round shaped X-ray tube having small the irradiation area, it is necessary to use a large number of X-ray tubes, and arrange them in an array. As a result, the round shaped X-ray tube is not totally satisfactory from a standpoint of facility and maintenance costs. Furthermore, in order to x-irradiate over a wide range, it may be possible to x-irradiate away from an object. However, it is required to increase irradiation intensity so as to x-irradiate the irradiation object in this instance, and an unnecessary area is x-irradiated. As a result, X-ray leakage problem is caused.

Accordingly, in order to solve the above problem in the conventional round-shaped X-ray tube, the inventers of the present invention invented a flat-shaped X-ray tube as shown in FIGS. 6 and 7. The X-ray tube comprises a package 55 which includes a substrate 53 made of radiopaque metal attached to an open-side periphery of a case 51 made of glass plates and formed in a box shape. On the substrate 53, a slit-shaped opening 52, as for example, about 2 mm in size is formed. In the package 55, an X-ray transmissive window 54 made of a titanium foil is attached to the opening 52 from the outside of the substrate 53 so that the opening 52 is closed. The inside of the package 55 is maintained in a high-vacuum state. In the package 55, a target 56 made of tungsten is arranged on the X-ray transmissive window 54 located on the opening 52 of the substrate 53. Furthermore, in the inside of the package 55, a back plate 57 is arranged on an inner surface opposite to the X-ray transmissive window 54. On the lower side of the back plate 57, a filamentary cathode 58, a first control electrode 59 deriving electrons from the cathode 58, and a second control electrode 60 accelerating the electrons derived by the first control electrode 59 are sequentially arranged.

According to the above X-ray tube, the electrons derived from the cathode 58 by the first control electrode 60 is accelerated by the second control electrode 60, and the X-ray generated by colliding with the X-ray target 56 penetrates through the X-ray transmissive window 54, and is emitted to the outside of the package 55. In this manner, titanium having good radiolucency and high intensity as material of the X-ray transmissive window 54 is used for the X-ray tube. The X-ray tube does not use beryllium which becomes hazardous by oxidation. Furthermore, since the X-ray is emitted from the X-ray transmissive window 54 regulated by the opening 52 of the substrate 53, the X-ray can be projected with a silt width of the X-ray transmissive window 54 substantively in a liner pattern over, the area in which the X-ray is radiated, if the size of the opening formed in the elongated slit-shaped is set in a desired size. Thus, it is possible to easily set the irradiation area of effective dimension in a relatively high freedom degree corresponding to the size of the object contrary to the X-ray tube in which the irradiation area is small and formed in round shape. In addition, if the size and shape of the opening 52 are formed with a desired size in the shape of rectangular groove, the area in which the X-ray is emitted in the X-ray transmissive window can be easily recognized from the outer shape compared with the circular X-ray transmissive window. Thus, it is relatively easy to set a pathway precisely guiding the X-ray in a predetermined position.

However, according to the flat shaped X-ray tube shown in FIGS. 6 and 7 proposed by the inventors of the present invention, the substrate 53 made of metal and the X-ray transmissive window 54 made of a titanium foil arranged on the opening 52 of the substrate 53 are deformed by external pressure resulting from vacuum atmosphere of the package 55. In some cases, the substrate 53 and the X-ray transmissive window 54 are broken to destroy the vacuum state in the package. Moreover, since the mechanical strength of the X-ray transmissive window 54 made of a titanium foil is low, the X-ray transmissive window 54 is damaged with a sight power, it is hard to arrange the X-ray transmissive window on the substrate 53, and the substrate 53 requires careful handing after attaching the X-ray transmissive window 54 to the substrate 53.

In view of problems of the flat shaped X-ray tube having an electron source and an X-ray target within a package explained hereinabove, an object of the present invention is to provide an X-ray tube which improves strength of the package near the X-ray transmissive window radiating X-ray outside of the package, and can be easy to arrange the X-ray transmissive window on the substrate and to handle the substrate after forming the X-ray transmissive window.

SUMMARY OF THE INVENTION

In order to attain the above object, the present invention provides an X-ray tube including a substrate having radiopaque first and second substrates made of a metal. Each of the first and second substrates is provided with a rectangular or slit shaped opening in which a framework is formed. An X-ray transmissive window is arranged between the first and second substrates to close the opening. The X-ray tube further includes a box-shaped case attached to the substrate. The inside of the case is maintained in high-vacuum state and an X-ray target is arranged on the opening of the substrate on which the X-ray transmissive window is fixed. Furthermore, the inside of the case includes an electron source comprising a plurality of control electrodes which includes a liner cathode extending along the opening of the substrate and an opening extending along the longitudinal direction of the cathode for deriving electron emitted from the cathode, and supplying the electrons to the X-ray target.

The electron source has at least a back plate formed on the inner surface of the case, a linear cathode, a first control electrode including a mesh-shaped opening extending along the longitudinal direction of the cathode, and a second control electrode including an opening smaller than the opening of the first control electrode, the second control electrode being located to surround the cathode and the first control electrode.

In the X-ray tube, a lattice shaped or honeycomb-shaped mesh is formed in the openings of the first and second control electrodes, respectively. The first and second substrates are made of 426 alloy, and the framework of the openings are formed by etching or pressing. The X-ray transmissive window is made of titanium which is sandwiched between the first and second substrates to have the first substrate, the second substrate and the X-ray transmissive window bonded by a thermal diffusion bonding to form the substrate. It is to be noted the framework arranged in the openings of the substrate is a lattice or honeycomb structure.

According to the X-ray tube of the present invention, the X-ray tube includes the opening in which the framework is formed. The X-ray transmissive window is sandwiched between the radiopaque first and second substrates made of a metal. Thus, the X-ray transmissive window is reinforced by the framework from both upper and back surfaces, and deformations of the substrate and the X-ray transmissive window inherent in a flat type X-ray tube can be prevented, and the strength of the package can be improved. Furthermore, the shape of the X-ray transmissive window defined by the opening can be selected at will, and it is not limited to the slender slit shape. For example, the shape of the X-ray transmissive window may be formed in a rectangular or square shape having a predetermined dimension with small aspect ratio. In addition, the metallic foil constructing the X-ray transmissive window is not exposed on the outer surface of the X-ray tube, and the X-ray transmissive window is protected because the framework formed in the opening is located on the outer side than the X-ray transmissive window. Therefore, even if a finger of a worker or object of some kind comes into incidentally touch with the X-ray transmissive window from the outer side of the package, any troubles resulting from the X-ray transmissive window being touched would not occur. Moreover, the liner cathode and the plurality of the control electrodes are provided extending along the shape of the opening of the substrate. Accordingly, X-ray can be uniformly taken out from almost all area of the opening of the substrate. Further, since the X-ray is emitted from the X-ray transmissive window corresponding to the opening of the substrate, the emission location or area of the X-ray can be accurately identified. According to the present invention, even if a number of X-ray tubes are used, a wide range of X-ray irradiation is possible. As a result, costs such as facility or maintenance can be reduced.

According to the X-ray tube of the present invention, the structure of the electron source is adapted to surround the liner cathode between the back plate and the first and second substrates. Thus, electrostatic charge on the inner surface of the case can be eliminated, and electric potential around the cathode can be stabilized. Furthermore, since the opening of the second control electrode is formed smaller than the opening of the first control electrode, a position in which electrons are ejected can be regulated, and an irradiation position of the electrons from the second control electrode can be controlled so that the electrons collide with only the portion position in the opening of the substrate of the X-ray target and the adjacent area. Therefore, electron collision in an unneeded area of the substrate can be prevented.

The lattice-shaped or honeycomb-shaped mesh is formed in the openings of the first and second control electrodes of the X-ray tube of the present invention increases the strength of the first and second control electrodes. As a result, electrical potential of the electron source can be stabilized.

The framework of the openings of the X-ray tube of the present invention are integrally formed on the substrate made of 426 alloy by etching or pressing, and the X-ray transmissive window made of titanium is sandwiched between the substrates made of 426 alloy and the substrates and the X-ray transmissive window are bonded by a thermal diffusion bonding. Accordingly, the strength of the substrate and the X-ray transmissive window can be further improved, which is, in turn to improve the package strength.

Furthermore, according to the X-ray tube of the present invention, there is lattice or honeycomb structure on the opening of the substrate, and the strength of the substrate is maintained by sandwiching the X-ray transmissive window between two substrates. Thus, the strength of the package can be further improved. In addition, the lattice or honeycomb structure on the opening of the substrate permits the opening ratio to increase which is, in turn to increase X-ray irradiation level.

These and other objects, features, and advantages of the present invention will become more apparent upon reading of the following detailed description along with the accompanied drawings.

DESCRIPTION OF THE PREFERRED EMBODIMENT

Figure 1:
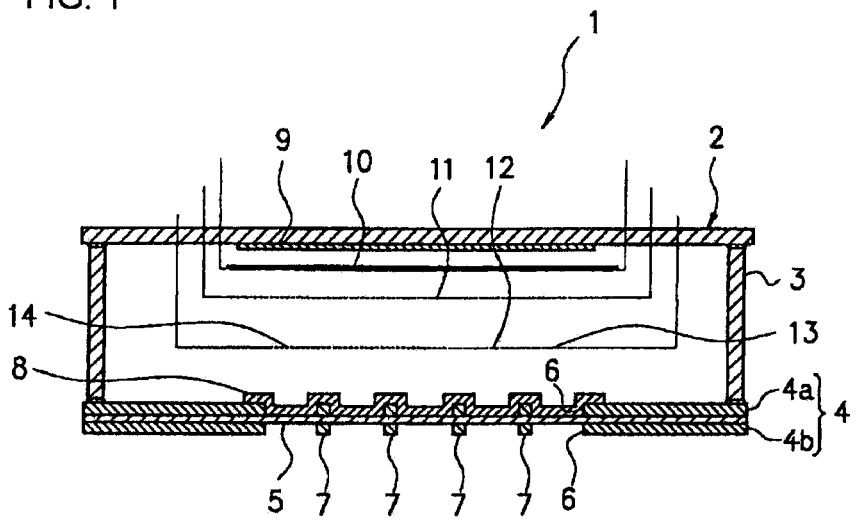
FIG. 1 is a cross-sectional view of an X-ray tube according to an embodiment of the present invention.

An X-ray tube according to an embodiment of the present invention will be explained with reference to FIGS. 1-5. A flat type X-ray tube 1 shown in FIG. 1 comprises a main body having a box shaped package 2. The package 2 is formed of a substrate 4 attached to an opening arranged on a periphery of a box shaped case 3 made of a glass plate and the opening is closed by the substrate 4. The substrate 4 consists of first and second substrates 4*a* and 4*b*, and an X-ray transmissive window 5 made of a titanium foil is sandwiched between the first and second substrates 4*a* and 4*b*. The inside of the package 2 is evacuated in a high-vacuum state. The substrate 4 is a rectangular plate made of radiopaque 426 alloy consisting of Ni of 42%, Cr of 6%, and the remaining Fe, and coefficient of thermal expansion of the 426 alloy are substantially equal to soda lime glass constituting the case 3.

Figure 2:
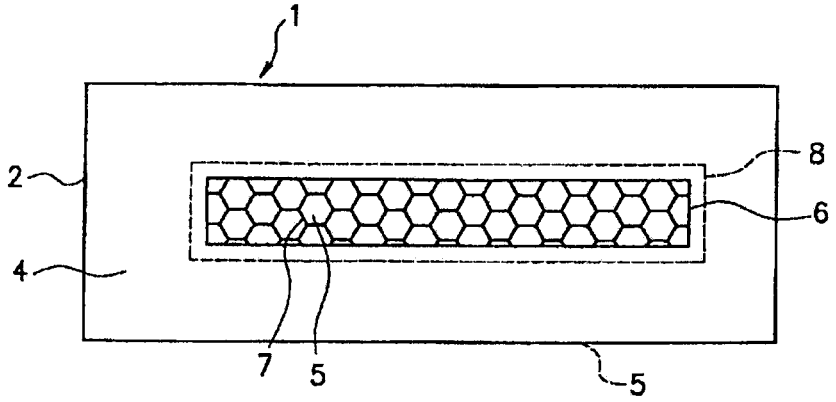
FIG. 2 is a plan view of the embodiment of the present invention.

As shown in FIG. 2, an elongated rectangular shaped or slit shaped opening 6 is formed in the center of the first and second substrates 4*a* and 4*b* along the longitudinal direction. Inside of the opening 6 includes a framework in a honeycomb structure 7, and an X-ray transmissive window 5 made of a titanium foil having about the same size as the first and second substrates 4*a* and 4*b* is sandwiched between the first and second substrates 4*a* and 4b. The X-ray transmissive window 5 of titanium foil held between the first and second substrates 4*a* and 4*b* are integrated by a thermal diffusion bonding in vacuum or an inert gas atmosphere to form the substrate 4. It is to be understood that the substrate 4 is made of metal material according to the present invention, the bonding property of the substrate with the X-ray transmissive window 5 made of metal foil is excellent. Here, the thermal diffusion bonding refers to a bonding method using atomic diffusion caused between the bonding surfaces under temperature conditions below the melting portion of base material after adhering tightly to the base material. Thus, the X-ray transmissive window 5 made of titanium foil is integrally formed in a portion in which the framework of the honeycomb structure is arranged so that the up and bottom of the X-ray transmissive window 5 are sandwiched in the portion, and supported by the rigid structure. Furthermore, in the other portion of the first and second substrates 4*a* and 4*b*, the titanium foil acts as an adhesive agent, and firmly to fix the first and second substrates 4*a* and 4*b* and to improve the strength of the substrate 4. It is difficult to process soda lime glass plate material constituting the case 3 into the above opening 6 and honeycomb structure 7, but the metal such as 426 alloy can be easily processed, while it is high in strength and the opening 6 and the honeycomb structure 7 can be easily formed by etching or pressing.

In the inside of the package 2, an X-ray target 8 is formed on the inner surfaces of the opening 6 of the first substrate 4*a* corresponding to the honeycomb structure 7 and the X-ray transmissive window 5 made of the titanium foil in such a manner that the X-ray target is deposited to the inner surface of the X-ray transmissive window 5 from the inside of the opening 6 by evaporating a tungsten film. As the X-ray target 8, metal, such as, molybdenum may be used other than tungsten.

Figure 3:
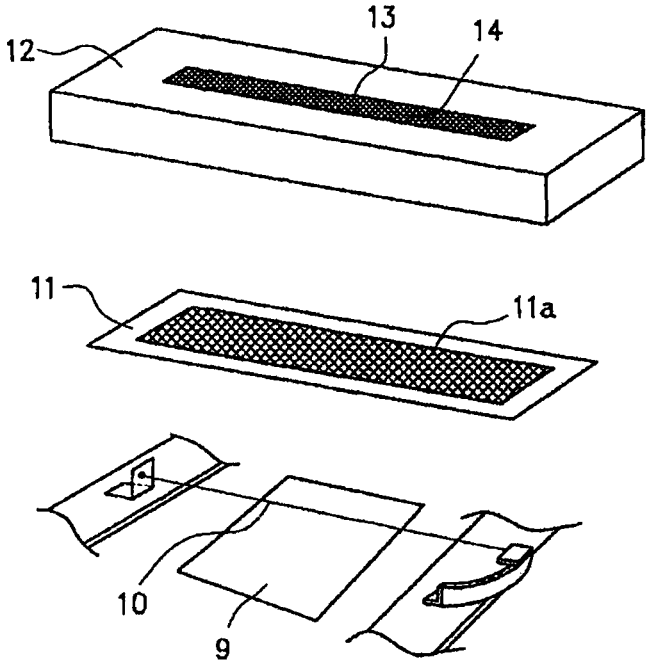
FIG. 3 is an exploded perspective view showing an electrode structure according to the embodiment of the present invention.

Next, electrode construction located in the inside of the package 2 will be explained. As shown in FIGS. 1 and 3, a back plate 9 for preventing electrostatic charge on glass is arranged on the inner surface of case 3 within the package 2 opposite to the X-ray transmissive window 5. On the lower side of the back plate 9, a liner cathode 10 as an electron source is stretched under tension, and a first control electrode 11 including mesh shaped openings 11*a* for deriving electrons from the cathode 10 is arranged on the lower side of the cathode 10. On the lower side of the first control electrode 11, a second control electrode 12 is arranged so as to controlling irradiation range of electron ray. In this manner, the electron source is formed of the back plate 9, the cathode 10, the first control electrode 11, and the second control electrode 12. The cathode 10 is formed of a core wire made of tungsten on the surface of which carbonate is deposited, and emits thermal electrons by energizing and heating the core wire. The first and second control electrodes 11 and 12 are provided with mesh shaped openings corresponding to the liner cathode 10, respectively. The second control electrode 12 is a box shaped electrode surrounded by plates on the four sides of the box shaped electrode, and is provided with a long narrow opening 13 having a mesh 14 on the portion corresponding to the liner cathode 10 in the second control electrode 12. The opening 13 and mesh 14 of the second control electrode 12 correspond to the opening 6 of the first substrate 4*a* and the X-ray target 8 located close to the opening 6, and irradiation range of the electrons emitted from the cathode 10 is controlled by the second control electrode to impinge upon the X-ray target 8 of the X-ray transmissive window 5 on the side of first substrate 4*a* or in the vicinity of the X-ray target 8 so that X-ray can be efficiently generated and ejected outside of the package 2. According to the X-ray tube of the present invention, a distance between the second control electrode 12 and X-ray target 8 is set to an appropriate value so that the electron collides with the X-ray transmissive window 5 properly.

As described above, since the cathode 10 is surrounded by the electrodes to which predetermined electric potential is applied, the cathode 10 is unaffected by electrostatic charge of the inner surface of the case, and the electric potential around the cathode 10 can be stabilized. According to the X-ray tube of the present invention, the second control electrode 12 has a function blocking the electrons of the cathode 10 so as to deteriorate insulation property between the X-ray target 8 as an anode and the cathode 10 by colliding the electrons derived from the first control electrode 11 with a place excluding the X-transmissive window 5 such as the inner wall of the package 2

If the distance between the case 3 and the liner cathode 10 is sufficiently maintained, the back plate 9 is not required, because effect of electrostatic charge for the case 3 is small. Furthermore, in addition to the first and second control electrodes, other control electrodes may be added depending upon the distance between the liner cathode 10 and the X-ray target 8, tube voltage, and focusing degree. Moreover, if material of the case 3 is a glass plate other than soda lime glass, the substrate 4 may use a metal plate other than 426 alloy, the coefficient of thermal expansion of which is equal to the soda lime glass. It is preferable that the first and second control electrodes 11 and 12 use 426 alloy so as to have the coefficient of thermal expansion nearly equal to the substrate 4. According to the X-ray tube 1 of the present invention, an ionized gas is generated to irradiate an X-ray to air and the like, and the resultant gas is applied to an electrical charged body subjected to neutralize for performing the neutralization processing.

Figure 4:
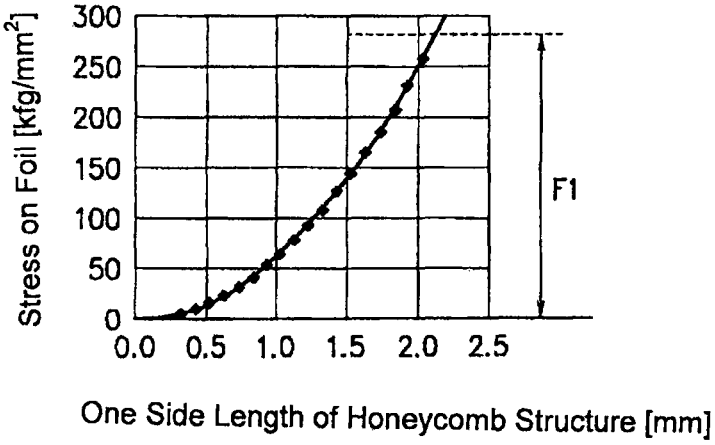
FIG. 4 is a graph showing a relationship between one side length of honeycomb structure and stress generated on a titanium foil according to the embodiment of the present invention.

Next, the inventors of the present invention examined a preferable condition of one side length of the honeycomb structure 7 of the opening 6. First, a substrate having the various sizes of opening or slit which does not have a honeycomb structure is prepared. Then, an X-ray tube which includes a titanium foil is 10 μm in thickness is produced using the substrate, and damages of the titanium foil was examined. As a result, when the width of the slit is equal to or less than at least 2 mm, the titanium foil was not damaged. Then, an upper limit of stress applied to the titanium foil in which the titanium foil at the opening is not damaged was examined by a simulation. As a result, it was found out that the upper limit of stress was 281 kgf/mm$^2$. Furthermore, by the simulation, the one side length of the honeycomb structure of the opening or slit was changed by fixing the thickness of the titanium foil to examine a range not exceeding the upper limit of the stress applied to the titanium foil. As a result, as shown in FIG. 4, when the one side length of the honeycomb structure 7 is equal to or less than at least 2.2 mm, the stress caused on the titanium foil does not exceed 281 kgf/mm$^2$ within the range of arrow F1 in FIG. 4, and it was found out that the titanium foil was not damaged.

Figure 5:
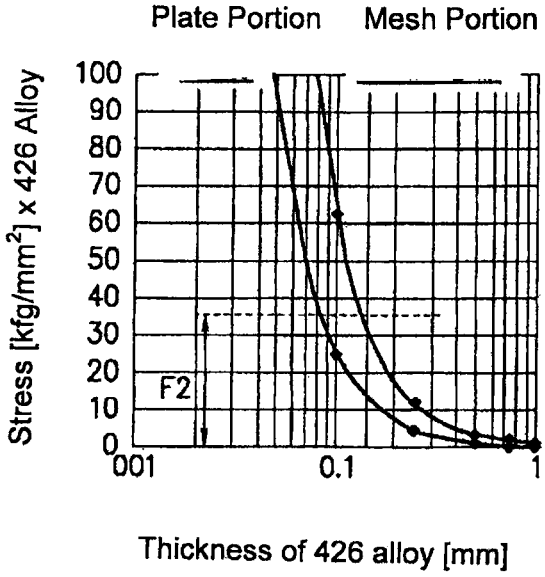
FIG. 5 is a graph showing a relationship between the thickness of a substrate made of 426 alloy and stress generated on the substrate according to the embodiment of the present invention.
Figure 6:
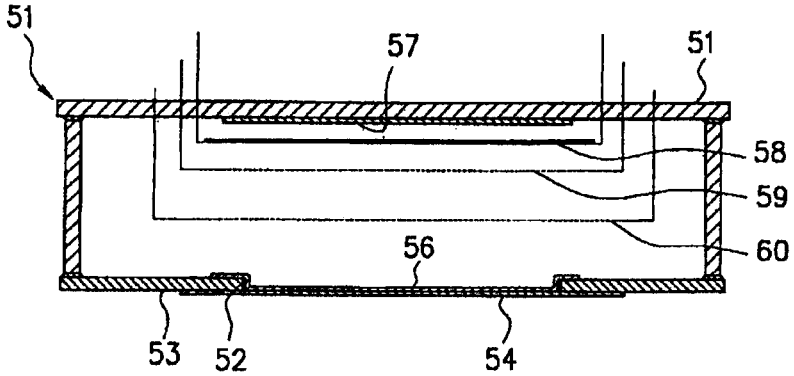
FIG. 6 Prior Art
FIG. 6 is a cross-sectional view of an X-ray tube proposed by inventor of the present invention.
Figure 7:
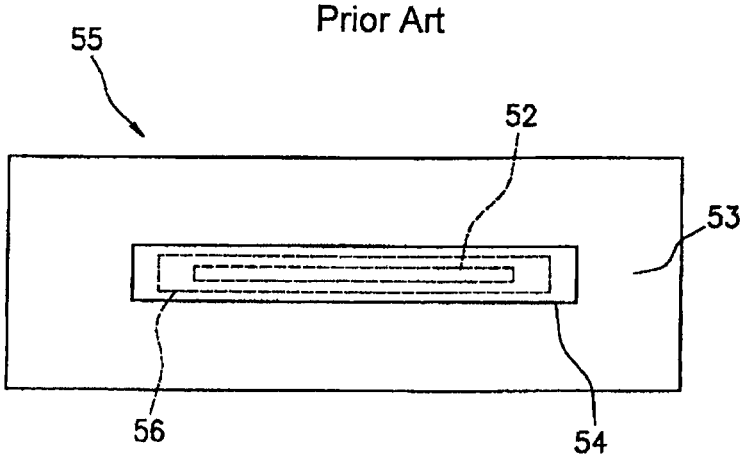
FIG. 7 Prior Art
FIG. 7 is a front view of the X-ray tube shown in FIG. 6.
Figure 8:
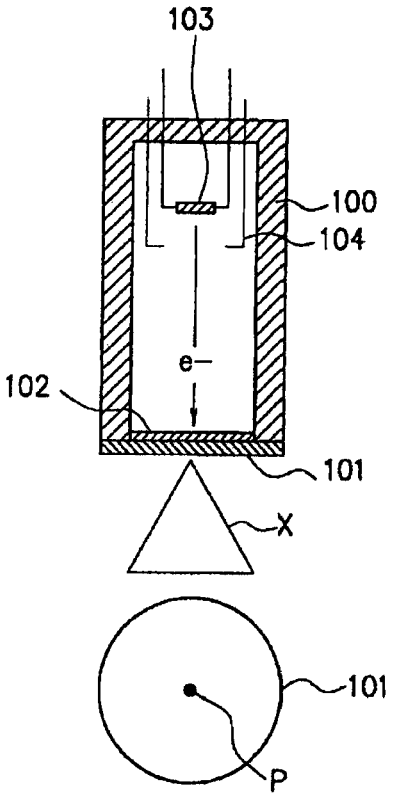
FIG. 8 Prior Art
FIG. 8 is a cross-sectional view of a conventional round shaped X-ray tube and an exemplary diagram showing the X-ray radiation range.

Additionally, a preferable thickness of the substrate 4 made of 426 alloy used by overlapping two substrates was examined. A relationship between the thickness of the 426 alloy and the stress caused on each portion of the honeycomb structure is shown in FIG. 5. As shown in FIG. 5, since the honeycomb structure 7 is positioned in the center of the substrate 4, the stress applied to the honeycomb structure 7 is higher than the plate portion, which necessitates to examine breaking strength in a portion of the honeycomb structure 7. Since the breaking strength of 426 alloy is approximately 37 kgf/mm$^2$ within the range of arrow F2 in FIG. 5, the required thickness of 426 alloy is approximately 0.2 mm. Thus, the thickness of one piece of 426 alloy used by overlapping two pieces in the embodiment of the present invention is at least 0.1 mm. In view of the above simulation, there is provided the X-ray tube 1 which is constructed by sandwiching the titanium foil, namely X-ray transmissive window 5, between two substrates 4 having the opening 6 including the honeycomb structure 7 under the condition that the thickness of titanium foil is 10 μm, the size of the package 2 is 18.5 mm long, 65 mm wide, and 12.8 mm thickness. The opening 6 is 44 mm×30 mm, the one side length of the honeycomb structure 7 is 1.5 mm, and wire diameter is 50 μm. In this structure, the X-ray tube 1 including the package 2 and the X-ray transmissive window 5 having sufficient strength can be obtained. Also, an experiment was carried out in a condition that the one side length of the honeycomb structure 7 is 1.5 mm, and the thickness of titanium foil is changed. As a result, when the thickness of titanium foil is 3 μm, breakage was caused. However, when the thickness thereof is not less than 5 μm and not more than 20 μm, problem did not occur.

As mentioned above, according to the X-ray tube 1 of the present invention, the electrons derived from the cathode 10 by the first control electrode 11 is controlled in the electric filed of the second control electrode 12, and the irradiation range is controlled around the area close to the opening 6 of the substrate 4. Furthermore, the electrons collide with the X-ray target 8 in the opening 6 or vicinity of the opening to generate X-ray. The X-ray is emitted from the X-ray transmissive window 5 restricted by the opening 6 of the substrate 4. Therefore, if the size and shape of the opening 6 is formed in the shape of rectangular groove of a desired size, the area in which X-ray is emitted can be linearized so that the X-ray is irradiated in the width of the X-ray transmissive window 5. Thus, for example, even if the X-ray tube is used for the purpose of X-ray irradiation for resolving electrostatic charge, it is possible to easily set irradiation area of effective size corresponding to the size and range of the object with relatively high freedom degree. Furthermore, if the size and shape of the opening 6 is formed in the shape of rectangular groove of a desired size, the area of the X-ray projected from the transmissive window 5 can be recognized relatively easy as compared with a circular X-ray transmissive window. Accordingly, it is easy to arrange equipments for guiding X-ray in a predefined position.

In the above embodiment, the example that the thickness of titanium foil is 10 μm is explained, but film thickness of the X-ray transmissive window can be changed in various sizes. Also, if the thickness of the overlapped first and second substrates 4*a* and 4*b* or of titanium foil is large, the one side length of the honeycomb structure 7 of the opening 6 can be elongated. On the other hand, if the thickness of the substrates 4*a* and 4*b* is thin, it is required to shorten the one side length of the honeycomb structure.

In addition, since the strength of the X-ray transmissive window 5 is improved by using the framework, the X-ray transmissive window 5 is not limited to a slender slit shape. For example, the shape of the X-ray transmissive window 5 may be formed in a planer shape having larger width. In that case, depending on the area of the opening 6 of the substrate 4, the required number of the liner cathode 10 may be arranged in parallel and stretched tightly. Furthermore, the framework provided in the opening 6 of the substrate 4 is not limited to the honeycomb structure. For example, the framework may be other network of evenly spaced horizontal bars or liners such as a grid structure. When the framework is the honeycomb or grid structure, the opening maintains higher strength than the opening of circular shape, and the opening rate can be increased. Moreover, titanium does not cause toxicity when being oxidized as can been seen in beryllium, and has good radiolucency. Thus, titanium is suitable for the X-ray transmissive window 5.

The X-ray tube 1 of the present invention is explained for use in performing antistatic processing by x-irradiating an object, but it is not limited thereto. For example, the X-ray tube 1 may be used for various purposes.

Additionally, in the above embodiment, during the process for manufacturing, the titanium foil is sandwiched between the first and second substrates 4*a* and 4*b* made of 426 alloy, and the titanium foil and 426 alloy are bonded by a thermal diffusion bonding. However the substrates 4*a* and 4*b* are not completely bonded together. Thus, the substrate 4 can be prepared by the thermal diffusion bonding at one time after overlapping a large number of the substrates 4. Accordingly, manufacture of the substrate 4 can be efficiently performed.

While, in the embodiment, the present invention is described, it is not limited thereto. Various change and modifications can be made with the scope of the present invention.

What is claimed is:

1. A X-ray tube comprising:

a substrate including radiopaque first and second substrates made of a metal;

a rectangular or slit shaped opening arranged in each of said first and second substrates having a framework;

an X-ray transmissive window arranged on the substrate, said X-ray transmissive window being sandwiched between the first and second substrates and closing the opening;

a box shaped case attached to the substrate, the inside of said case being in high-vacuum state;

an X-ray target arranged on the opening of the substrate in the inside of the case and adhering to the X-ray transmissive window, and an electron source arranged in the inside of the case, said electron source having a plurality of control electrodes including a liner cathode extending along the opening of the substrate and an opening extending along the longitudinal direction of the cathode for deriving electrons emitted from the cathode, and supplying the electrons to the X-ray target.

2. The X-ray tube as claimed in claim 1, wherein the electron source includes at least a back plate formed on an inner surface of the case, a linear cathode, a first control electrode including a mesh shaped opening corresponding to the longitudinal direction of the cathode, and a second control electrode including an opening smaller than the opening of the first control electrode, the second control electrode being located to surround the cathode and the first control electrode.

3. The X-ray tube as claimed in claim 1, wherein a lattice shaped or honeycomb shaped mesh is formed in the openings of the first and second control electrodes, respectively.

4. The X-ray tube as claimed in claim 3, wherein the first and second substrates are made of 426 alloy, and the framework is formed by etching or pressing, and wherein the X-ray transmissive window is made of titanium, said X-ray transmissive window being sandwiched between the first and second substrates to have the first substrate, the second substrate and the X-ray transmissive window bonded by a thermal diffusion bonding to form the substrate.

5. The X-ray tube as claimed in claim 4, wherein the framework arranged in the opening of the substrate is lattice or honeycomb structure.

* * * * *